US006968847B2

(12) United States Patent
Lorenzen

(10) Patent No.: US 6,968,847 B2
(45) Date of Patent: Nov. 29, 2005

(54) METHOD OF AND APPARATUS FOR MEASURING THE DIAMETERS OF ROD-SHAPED ARTICLES

(75) Inventor: Heinz-Christen Lorenzen, Wentorf (DE)

(73) Assignee: Hauni Maschinenbau AG, Hamburg (DE)

( * ) Notice: Subject to any disclaimer, the term of this patent is extended or adjusted under 35 U.S.C. 154(b) by 302 days.

(21) Appl. No.: 10/350,337

(22) Filed: Jan. 24, 2003

(65) Prior Publication Data

US 2003/0154992 A1 Aug. 21, 2003

(30) Foreign Application Priority Data

Jan. 25, 2002 (DE) ..... 102 03 095

(51) Int. Cl.[7] ..... A24C 5/32; G01B 11/02
(52) U.S. Cl. ..... 131/280; 131/906; 356/635
(58) Field of Search ..... 131/280, 906; 382/141; 73/37.6, 37.8; 356/237.1, 635

(56) References Cited

U.S. PATENT DOCUMENTS

| | | | | |
|---|---|---|---|---|
| 3,604,430 A | | 9/1971 | Norwich et al. | |
| 4,121,595 A | | 10/1978 | Heitmann et al. | |
| 4,412,505 A | | 11/1983 | Haüsler et al. | |
| 4,543,816 A | * | 10/1985 | Brand et al. | 73/37.6 |
| 4,616,139 A | | 10/1986 | Heitmann | |
| 4,805,641 A | | 2/1989 | Radzio et al. | |
| 5,135,008 A | | 8/1992 | Oesterling et al. | |
| 5,526,826 A | | 6/1996 | Heitmann | |
| 5,715,843 A | | 2/1998 | Hapke et al. | |
| 6,516,083 B1 | * | 2/2003 | Bonechi et al. | 382/141 |

FOREIGN PATENT DOCUMENTS

| | | |
|---|---|---|
| DE | 12 38 223 B | 4/1967 |
| DE | 27 17 473 | 11/1978 |
| DE | 34 14 247 | 10/1984 |
| DE | 34 14 247 A1 | 10/1984 |
| DE | 38 06 320 | 9/1989 |
| DE | 195 23 273 | 1/1997 |
| EP | 0 617 901 A2 | 10/1994 |

* cited by examiner

*Primary Examiner*—Dionne A. Walls
(74) *Attorney, Agent, or Firm*—Venable LLP; Robert Kinberg; Catherine M. Voorhees

(57) ABSTRACT

There is provided an apparatus which can be incorporated into machines or production lines for the making of rod-shaped articles, such as filter cigarettes. The apparatus ascertains at least the diameters of longitudinally spaced-apart portions of an article, such as a continuous cigarette rod having equidistant portions of greater density, while the article advances lengthwise at a constant speed or at one of several different speeds. Accurate determination of the diameters of spaced-apart portions and, if necessary, a change of the diameter when it deviates from an optimum value, renders it possible to reduce the number of rejects and to turn out high-quality products, such as filter cigarettes wherein the mouthpiece is attached to the dense ends of the plain cigarettes; this ensures that the diameter of the dense end is identical with or sufficiently close to that of the filter mouthpiece so that the customary uniting band can secure the mouthpiece to the plain cigarette without leakage.

17 Claims, 3 Drawing Sheets

METHOD OF AND APPARATUS FOR MEASURING THE DIAMETERS OF ROD-SHAPED ARTICLES

CROSS-REFERENCE TO RELATED CASES

This application claims the priority of the commonly owned copending German patent application Serial No. 102 03 095.2 filed Jan. 25, 2002. The disclosure of the above-identified German patent application, as well as that of each US and/or foreign patent and/or patent application identified in the specification of the present application, is incorporated herein by reference.

BACKGROUND OF THE INVENTION

This invention relates to improvements in methods of and in apparatus for ascertaining and utilizing certain parameters of plain or filter cigarettes, cigars, cigarillos, filter rod sections and certain other rod-shaped articles. More particularly, the invention relates to improvements in methods of and in apparatus for ascertaining the diameters of rod-shaped articles while the articles move lengthwise, e.g., for ascertaining the diameter of a cigarette rod which is caused to move lengthwise through a monitoring station prior to being subdivided into discrete plain cigarettes of unit length or multiple unit length.

The invention also relates to improvements in methods of and in apparatus for altering or correcting the diameter of a rod-shaped article which is caused to advance lengthwise, which tends (at least a times) to exhibit or develop a diameter which departs from a desired or required or optimum value, and wherein a rod-like filler is surrounded by a tubular envelope or wrapper of cigarette paper, artificial cork or other so-called tipping paper or other web-like wrapping material for plain or filter cigarettes or the like.

The invention further relates to improvements in machines (such as production lines each of which includes a cigarette maker, a maker of or a storage facility for tipping paper, a maker of or a magazine for filter mouthpieces and a maker of filter cigarettes or analogous rod-shaped products of unit length or multiple unit length) wherein the diameter(s) of a running rod-shaped article or of several running rod-shaped articles is or are or can be influenced by signals denoting the ascertained diameters of finished or partly finished rod-shaped articles.

Although the method and the apparatus of the present invention can be put to use for the monitoring of diameters of a wide variety of rod-shaped articles, one of their presently preferred uses is in connection with the mass production of rod-shaped articles which can constitute smokers' products (with or without filter mouthpieces) or which constitute filters for smoke (such as mouthpieces for use in the making of filter cigarettes, filter cigarillos and the like).

An important aspect of the making of high-quality rod-shaped smokers' products (such as filter cigarettes) is to ensure that all components of such articles exhibit diameters which match or at least very closely approach predetermined diameters. For example, a continuous cigarette rod wherein a so-called rod-like filler of natural, artificial and/or reconstituted tobacco is confined in a tubular envelope or wrapper of cigarette paper or the like must or should have a predetermined (optimum) diameter, especially if the rod is to be subdivided into plain cigarettes of unit length or multiple unit length.

If the thus obtained plain cigarettes are to be packed and sold as plain cigarettes, adherence to a predetermined optimum diameter is desirable for the convenience of assembling such plain cigarettes into arrays (e.g., into so-called quincunx formations wherein a median layer of six parallel cigarettes is flanked by two layers of seven parallel cigarettes each, and wherein the cigarettes of the median layer are staggered (offset) relative to cigarettes in the outer layers). Adherence to an optimum diameter is desirable on the additional ground that it enhances the appearance of the cigarettes and ensures the making of a reliable seam (where the two marginal portions of the wrapper overlie and adhere to each other) of constant width.

It is perhaps even more important to ensure that a cigarette which is to be assembled with a filter mouthpiece in a so-called tipping machine exhibit a predetermined diameter, at least at one of its ends, because this ensures the making of a reliable leakproof connection between one end of the plain cigarette and one end of the mouthpiece. The connection (which is normally established by a convoluted strip of tipping paper, such as artificial cork) is much more likely to be leakproof if the diameter of the one end of the plain cigarette matches the diameter of the adjacent end of the mouthpiece. This applies irrespective of the exact mode of making filter cigarettes. A presently preferred mode is disclosed in commonly owned U.S. Pat. No. 5,135,008 granted Aug. 4, 1992 to Oesterling et al. for "METHOD OF AND APPARATUS FOR MAKING FILTER CIGARETTES". Penetration of uncontrollable quantities of air to a filter cigarette at a leaky junction between the plain cigarette and the filter mouthpiece is undesirable in spite of the fact that it is often desirable or even necessary to perforate the wrapper of a plain or filter cigarette in order to admit atmospheric air in quantities which are deemed desirable in order to exert a beneficial influence upon the nicotine and/or condensate content of tobacco smoke. Reference may be had, for example, to U.S. Pat. No. 4,121,595 granted Oct. 24, 1978 to Heitmann et al. for "APPARATUS FOR INCREASING THE PERMEABILITY OF WRAPPING MATERIAL FOR ROD-SHAPED SMOKERS' PRODUCTS".

German patent No. 34 14 247 A1 discloses a method of and an apparatus for pneumatically ascertaining the diameters of rod-shaped articles. The patent proposes the utilization of air at constant pressure and substantially continuous monitoring of the diameter of a continuously advanced rod-shaped article. The monitoring device comprises a nozzle defining a small annular testing chamber which surrounds the continuously advancing rod-shaped article. The nozzle is operatively connected with a testing unit which is set to respond to air pressure below that required to effect a deformation of the tested article. Furthermore, the nozzle is integrated into a rod guiding arrangement in such a way that the testing chamber and the guiding arrangement flank a larger expansion chamber which communicates with the atmosphere.

An optical measuring system for the diameters of rod-shaped commodities is disclosed in German patent No. 195 23 273 A1 and in the corresponding U.S. Pat. No. 5,715,843 granted Feb. 10, 1998 to Hapke et al. for "METHOD OF AND APPARATUS FOR MEASURING THE DIAMETERS OF ROD-SHAPED ARTICLES OF THE TOBACCO PROCESSING INDUSTRY". These patents propose to rotate a practically finished cigarette about its axis during continuous or discontinuous sidewise movement and to simultaneously direct against the cigarette a laser beam. The amounts of intercepted radiation are indicative of the diameters of the respective articles; such amounts are monitored by a camera serving to generate electric signals which are processed into second signals denoting the diameters of discrete successively tested cigarettes and/or the average diameters of series of successively tested cigarettes.

German patent No. 38 06 320 A1 proposes a method of and an apparatus for monitoring the diameter of the tubular wrapper surrounding a rod-like filler of tobacco or filter material for tobacco smoke. A first measuring unit is employed to ascertain the width of the web or strip which is to be converted into the tubular wrapper, and a second measuring unit serves to monitor the width of the seam which is established by the overlapping marginal portions of the tubular wrapper, i.e., of the converted web or strip. An evaluating arrangement is employed to process the signals denoting the width of the web and the signals denoting the width of the seam into further (difference) signals which are indicative of the diameter of the tubular wrapper, i.e., of the article consisting of a rod-like filler and the tubular wrapper around it.

German patent No. 27 17 473 A1 proposes a control arrangement for a combination of a cigarette rod maker and a filter tipping machine which latter is directly coupled to the maker and is set up to turn out filter cigarettes. The filter tipping machine includes a measuring arrangement which is designed to detect fluctuations of the diameters of filter rod sections which are to be united with plain cigarettes to form therewith filter cigarettes of desired length. The maker of plain cigarettes is provided with a control unit which can influence the diameter of the cigarette rod being produced therein. The measuring arrangement of the filter tipping machine serves to transmit to the control unit of the maker a series of reference signals or desired-value signals. Such combination of the measuring arrangement and of the control unit is intended to enable the maker to turn out plain cigarettes having diameters best suited for attachment to the filter mouthpieces which are being processed in the tipping machine.

OBJECTS OF THE INVENTION

An object of the instant invention is to provide a novel and improved method of reliably ascertaining the diameters of rod-shaped articles or commodities, such as plain or filter cigarettes, cigarillos, cigars and/or other rod-shaped smokers' products.

Another object of the invention is to provide a method which can be resorted to for reliable determination of the diameters of selected portions of rod-shaped articles such as plain cigarettes, filter cigarettes and/or the like.

A further object of this invention is to provide a novel and improved apparatus for the practice of the above outlined methods.

An additional object of the invention is to provide the apparatus with a novel and improved combination of diameter measuring means and actuating means enabling the measuring means to ascertain the diameters of selected parts or portions of rod-shaped articles.

Still another object of the invention is to provide a machine, such as a cigarette maker, which embodies the above outlined apparatus.

A further object of the present invention is to provide a production line conisting of a combination of a cigarette maker and a filter tipping machine and embodying the above outlined apparatus.

Another object of the invention is to provide an apparatus which can be built into existing machines or production lines to enhance their reliability and the quality of their rod-shaped products as well as to reduce the number of rejects.

SUMMARY OF THE INVENTION

One feature of the present invention resides in the provision of a method of ascertaining the diameter of an elongated rod-shaped article, such as a continuous cigarette rod. The method comprises the steps of advancing the article lengthwise (e.g., with the so-called garniture of the wrapping mechanism in a cigarette rod making machine), monitoring the diameter of the advancing article, and generating signals which denote the diameters of discrete longitudinally spaced-apart portions of the advancing article.

The article can comprise a rod-like filler (e.g., a tobacco filler) and a tubular wrapper (such as a converted web of cigarette paper) for the filler. In addition to or in lieu of tobacco, the filler can also include or consist of filter material for smoke, particularly tobacco smoke. In many instances, the filler includes or can constitute a continuous trimmed rod-like filler.

In accordance with a presently preferred embodiment, the monitoring step includes monitoring the diameters of successive increments of the advancing article, and the aforementioned discrete portions of the article are separated from each other by pluralities of such increments.

The discrete portions of the advancing article are or can be at least substantially equidistant from each other. The advancing step of such method can include moving the article lengthwise at a selected one of a plurality of different speeds, and such method can further comprise the step of varying the frequency of signal generation as a function of variations of the speed of lengthwise movement of the article so that the aforementioned portions of the advancing article remain equidistant from each other.

If the article includes a rod-like filler of smokable material having longitudinally spaced-apart densified sections such as are customary in a cigarette rod to be subdivided into plain cigarettes which are to be introduced into a tipping machine (i.e., which are to form part of filter cigarettes), each of the aforementioned portions of the article can at least substantially coincide with a different one of the densified sections. Such method can further comprise the step of severing the article at each of the sections. The severing step can include subdividing the article into a succession of discrete rod-shaped smokers' products of unit length or multiple unit length.

Another feature of the present invention resides in the provision of a method of making an elongated rod-shaped article having a variable diameter. This method comprises the steps of confining an elongated rod-like filler into a tubular wrapper and advancing the thus obtained elongated article lengthwise, monitoring the diameter of the advancing article, generating signals which denote the diameters of discrete longitudinally spaced-apart portions of the advancing article, and utilizing the signals to select the diameter of the article prior to the monitoring step.

The filler can contain a continuous smokable material and/or a continuous filter material for smoke, such as tobacco smoke.

A further feature of the present invention resides in the provision of an apparatus for ascertaining the diameter of an elongated rod-shaped article. The improved apparatus comprises means (such as the aforementioned endless belt or band called garniture) for advancing the article lengthwise along a predetermined path, means for monitoring the diameter of the advancing article in a predetermined portion of the path, including signal generating means which is actuatable to generate signals denoting the diameter of the article, and means for actuating the signal generating means at intervals so that the signals denote the diameters of discrete longitudinally spaced-apart portions of the advancing article.

The monitoring means can further include a sensor which is arranged to ascertain the diameters of successive increments of the advancing article, and the aforementioned discrete portions of the advancing article are or can be spaced apart from each other by pluralities of such increments.

The advancing means can be arranged to move the article at any one of a plurality of different speeds, and the actuating means of such apparatus can be arranged to actuate the signal generating means in such a way that the longitudinally spaced-apart portions of the advancing article are at least substantially equidistant from each other irrespective of the selected speed of the advancing article.

The improved apparatus can be arranged to ascertain the diameter of an article having longitudinally spaced-apart densified sections each of which at least substantially coincides with one of the aforementioned portions of the advancing article.

The apparatus can further comprise means for severing the advancing article at the spaced-apart densified sections.

The advancing means can form part of a cigarette making machine, and such apparatus or the machine can further comprise means for utilizing the signals to select the diameter of the article being turned out by the machine. The utilizing means preferably includes means for processing the signals.

The novel features which are considered as characteristic of the invention are set forth in particular in the appended claims. The improved apparatus itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawing.

DESCRIPTION OF PREFERRED EMBODIMENTS

Figure 1:
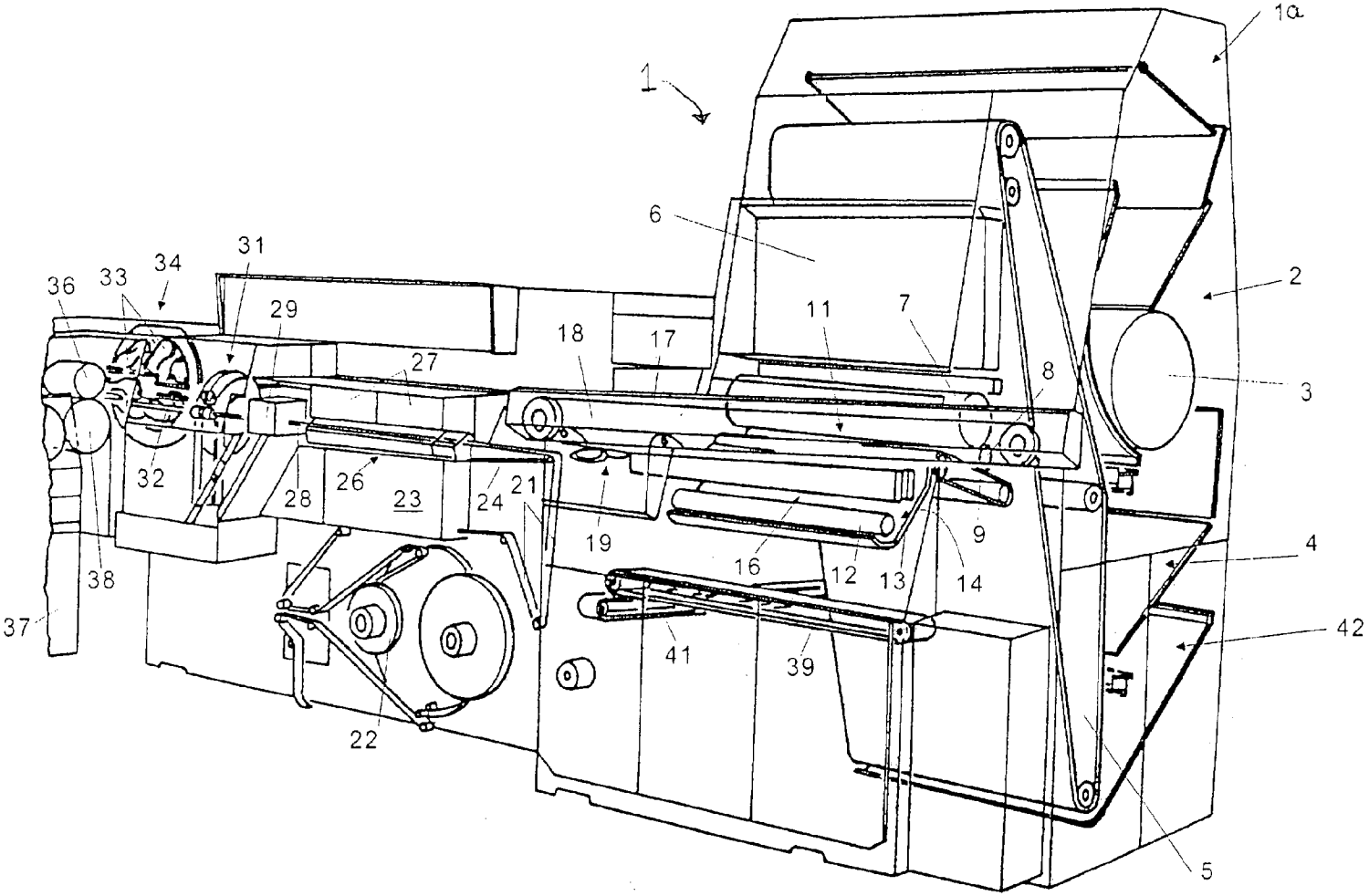
FIG. 1 is a fragmentary schematic perspective view of a production line including a cigarette maker and a filter tipping machine as well as an apparatus which embodies one form of the present invention.

FIG. 1 shows a production line which is set up to turn out filter cigarettes of unit length or multiple unit length. This production line comprises a maker 1 of plain cigarettes 32 and a tipping machine 37 which converts plain cigarettes and filter mouthpieces into filter cigarettes. The cigarette maker can be of the type known as "PROTOS" which is distributed by the assignee of the present application. A similar cigarette maker is disclosed in commonly owned U.S. Pat. No. 4,805,641 granted Feb. 21, 1989 to Radzio et al. for "METHOD AND APPARATUS FOR ASCERTAINING THE DENSITY OF WRAPPED TOBACCO FILLERS AND THE LIKE". A machine which can turn out filter mouthpieces for delivery to the tipping machine 37 is disclosed, for example, in U.S. Pat. No. 4,412,505 granted Nov. 1, 1983 to Häusler et al. for "APPARATUS FOR APPLYING ATOMIZED LIQUID TO A RUNNING LAYER OF FILAMENTARY MATERIAL OR THE LIKE".

The maker 1 which is shown in FIG. 1 comprises a distributor or hopper including a gate 1*a* which discharges, at requisite intervals, batches of shredded tobacco particles into a first magazine 2. A tobacco removing roller-shaped conveyor 3 transfers tobacco particles from the first magazine 2 into a second magazine 4 of the distributor so that the magazine 4 contains a substantially constant supply of shredded tobacco adjacent the upwardly advancing reach or stretch of an endless belt- or chain-shaped elevator conveyor 5 having a series of successive pockets which transport batches of tobacco particles into an upright gathering duct 6 of the distributor of the cigarette maker 1.

A carded rotary drum-shaped conveyor 7 draws tobacco particles from the outlet at the lower end of the duct 6 and moves its carding past a rapidly rotating picker roller 8. The latter expels tobacco particles from the carding of the conveyor 7 and propels them onto the upper reach or stretch of a constant-speed endless apron 9. This apron gathers a substantially uniform layer of tobacco particles and propels successive increments of such layer against a pneumatic sifter 11 which acts as a classifying device. The illustrated sifter 11 is assumed to comprise a row of nozzles which propel jets of compressed air vertically or nearly vertically downwardly. Heavier tobacco particles (such as fragments of tobacco ribs) of the stream on the apron 9 penetrate the curtain of air and gather in a collecting receptacle (not shown) which is emptied at requisite intervals, or on a suitable conveyor which evacuates the heavier particles from the maker 1. Lighter tobacco particles (primarily the desirable fraction of the tobacco stream, such as shredded tobacco leaf laminae) are intercepted by the air streams of the pneumatic sifter 11 and are directed into an elongated funnel 14 defined by an upright or substantially upright wall 13 in combination with a carded roller or drum 12. The funnel 14 discharges successive increments of the mixture of shredded tobacco and tobacco dust (if any) into an elongated channel 16 below the lower reach of an elongated endless foraminous belt- or band-shaped conveyor 17. The lower reach of this conveyor is disposed below the at least partially open underside of a suction chamber 18 which attracts the tobacco shreds and causes them to form a growing elongated tobacco stream which advances with the conveyor 17 in a direction to the left, as viewed in FIG. 1.

The fully grown tobacco stream advances beyond the suction chamber 18 and into the range of a suitable trimming or equalizing device 19, e.g., a device of the type disclosed in commonly owned U.S. Pat. No. 5,526,826 granted Jun. 18, 1996 to Heitmann for "APPARATUS FOR REMOVING SURPLUS FROM A TOBACCO STREAM". Such trimming device is normally utilized in cigarette makers which are designed to produce a continuous cigarette rod with longitudinally spaced-apart densified portions. The continuous rod is severed across the densified portions to thus yield cigarettes having rod-shaped tobacco fillers with dense portions at their ends. The dense portions are disposed at those ends of the plain cigarettes which are adjacent the filter mouthpieces of the filter cigarettes containing such plain cigarettes, and/or at the other ends which are lighted by the smokers of plain or filter cigarettes.

Successive increments of the trimmed or equalized rod-like tobacco filler advancing beyond the trimming device 19 enter a wrapping mechanism 26 wherein they are draped into a continuous web or strip 21 of cigarette paper which forms a tubular envelope or wrapper surrounding the rod-like tobacco filler and forming therewith an endless rod-shaped article 28, namely a cigarette rod wherein the tobacco filler which is confined in the tubular wrapper contains equidistant densified portions developed as a result of the aforediscussed configuration of the trimming device 19.

The source 22 which supplies the cigarette paper web 21 is normally a bobbin or reel, and successive increments of the web 21 leaving the bobbin 22 advance past an imprinting device 23 which applies to one side of the running web suitable printed matter, e.g., the trademark(s) of the manufacturer, the name of the manufacturer and/or other information. The running web 21 is further provided with a film of adhesive, at least along one of its longitudinally extending marginal portions, e.g., ahead of an elongated endless belt or band conveyor 24 forming part of the wrapping mechanism and known as garniture. The seam which is obtained as a result of bonding the adhesive-coated marginal portion of the running web 21 to the other marginal portion of the web is stabilized by a tandem sealer 27 to ensure that the seam remains intact during further treatment of the continuous rod-shaped article 28 in the cigarette maker 1 and in the filter tipping machine 37. The garniture 24 constitutes or forms part of the means for advancing the rod-shaped article 28 lengthwise in and beyond the wrapping mechanism 26. The aforementioned paster can form part of or can be installed adjacent the printer 23 or adjacent the garniture 24 but upstream of the sealer 27 (as seen in the direction of advancement of the web 21). The arrangement can be such that one marginal portion of the web 21 extends from the remainder of the tubular wrapper of the continuous cigarette rod 28 when the conversion of the web 21 into the wrapper is substantially completed, and the inner side of such extending marginal portion is thereupon coated with adhesive (such as a hot melt) prior to folding it over the outer side of the other marginal portion, e.g., immediately upstream of or adjacent the sealer 27.

Successive increments of the continuous cigarette rod 28 enter into an apparatus 29 which embodies one form of the present invention and serves to ascertain the diameters of longitudinally spaced-apart sections of the rod 28, namely those sections which were densified by the trimming device 19. The details of one embodiment of the apparatus 29 are shown in and will be described with reference to FIG. 2. The diameter-ascertaining apparatus 29 is followed by a cutoff 31 which repeatedly severs the advancing cigarette rod 28 in order to convert the latter into a series or file of plain cigarettes 32 of double unit length. Successive plain cigarettes 32 are engaged and advanced by discrete arms 33 of a rotary transfer conveyor or unit 34 which deposits them at the periphery of a rotary drum-shaped intermdiate conveyor 36 forming part of the tipping machine 37. A knife 38 is preferably provided adjacent the intermediate conveyor 36 to subdivide successive plain cigarettes 32 of double unit length into pairs of plain cigarettes of unit length. The manner in which the plain cigarettes being supplied by the conveyor 36 are united with filter mouthpieces to form therewith filter cigarettes is or can be the same as that disclosed in the aforementioned U.S. Pat. No. 5,135,008 to Oesterling et al. Such tipping machines (distributed by the assigneee of the present application) are known as MAX and MAX S.

FIG. 1 further shows two endless belt or band conveyors 39 and 41 which serve to transport surplus tobacco (removed by the trimming device 19) from the trimming station at the downstream end of the endless foraminous band conveyor 17 into the distributor of the cigarette maker 1. To this end, the distributor comprises a magazine or receptacle 42 which is adjacent the ascending reach of the elevator conveyor 5 and delivers to the latter small batches of tobacco shreds and tobacco dust (if any) for transport into the duct 6.

Figure 2:
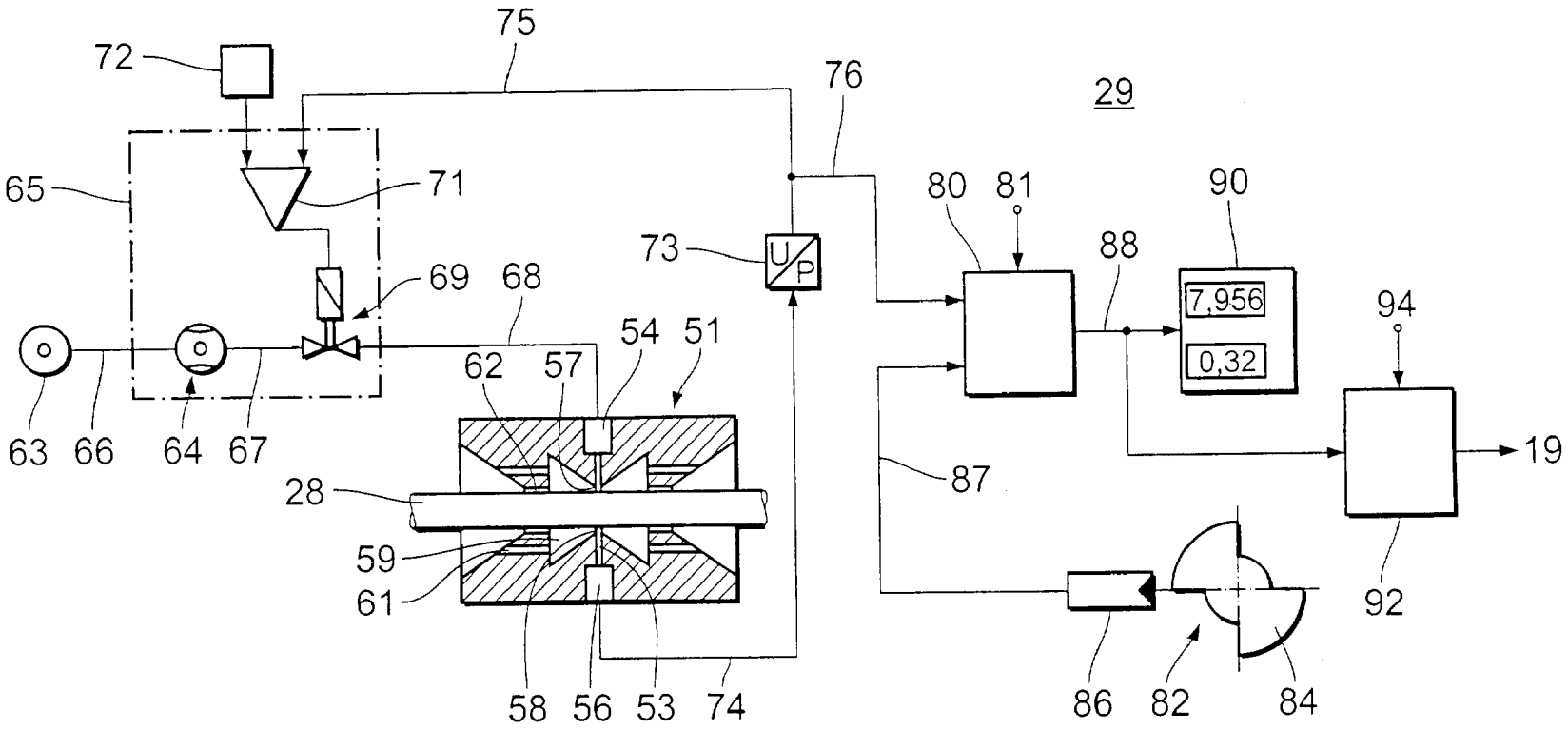
FIG. 2 is a diagrammatic view of the apparatus which is employed in the production line of FIG. 1.

The relevant details of the apparatus 29 for ascertaining the diameter of the elongated rod-shaped article (continuous cigarette rod) 28 are shown in FIG. 2. This apparatus comprises a nozzle 51 which can be said to constitute a sensor arranged to monitor the diameters of successive increments of the continuously advancing rod 28. To this end, the nozzle 51 is provided with a narrow annular testing compartment 53 through which the rod 28 advances under the action of the garniture 24. The compartment 53 communicates with a radial air supplying connecting passage 54 which supplies compressed air from a source 63 by way of a conduit 66, a flow meter 64, a conduit 67, an electric valve 69 and a conduit 68.

The compartment 53 further communicates with a connecting channel or bore 56 provided in the nozzle 51 and leading to a testing conduit 74 which is connected to a voltage converter 73. The sides of the compartment 53 are flanked by radial walls having pronounced edges 57 closely adjacent to the external surface of the tubular wrapper forming part of the advancing cigarette rod 28. The edges 57 and the tubular wrapper define narrow annular testing clearances 58. These clearances connect the testing compartment 53 with two larger-diameter and wider annular chambers 59 in the nozzle 51. The chambers 59 are connected with the atmosphere by aerating orifices 61.

The nozzle 51 is further provided with two annular aerating orifices 62 which surround a portion of the path for the cigarette rod 28 and each of which is outwardly adjacent a different one of the chambers 59. The diameters of the orifices 62 are smaller than that of the testing compartment 53; this is desirable because such selection of the diameters ensures that eventual remnants of adhesive borne by the seam of the tubular wrapper of the cigarette rod 28 are intercepted at and gather in one of the orifices 62 rather than in the testing clearance 58.

The source 63 normally supplies air at a pressure of 2–5 bar. The aforementioned flow meter 64 (which is connected to the source 63 by the aforesaid conduit 66) forms part of a commercially available testing unit 65 which further includes the electric valve 69 and an electric regulator 71 for the valve 69. A first input of the regulator 71 is connected to a source 72 of reference signals, and another of its inputs is connected with the voltage converter 73 by a conductor 75. The valve 69 serves to maintain the air in the testing compartment 53 at a constant pressure. The conduit 74 supplies to the voltage converter 73 air at a pressure corresponding to that prevailing in the compartment 53, and the converter 73 converts such pressure into an electric (voltage) signal and transmits the electric signal to the corresponding input of the regulator 71 by way of the conductor 75.

The mode of operation of the heretofore described parts of the testing apparatus 29 is as follows:

If the cross-sectional area, and hence the the diameter, of a length of the cigarette rod 28 advancing through the nozzle 51 matches or sufficiently approximates the desired (optimum) value, a corresponding quantity of air being supplied by the source 63 and flowing through the conduit 66, flow meter 64, conduit 67, conductor 68 and passage 54 flows through the annular testing compartment 53. For example, the pressure of air in this compartment can be in the range of 10 millibar if the diameter of the tubular wrapper of the advancing cigarette rod 28 is satisfactory. Such pressure is being applied to successive annular increments of the external surface of the tubular wrapper, namely to annular increments having an axial length (i.e., as seen in the axial direction of the cigarette rod 28) corresponding to the width of the testing compartment 53. The selection of such narrow testing clearance is desirable and advantageous because the results of diameter measurement are less influenced, or are not influenced at all, by changes of permeability of the normally or often highly porous tubular wrapper (converted cigarette paper web 21).

From the testing compartment 53, the air being supplied by the source 63 flows parallel to the direction of advancement of the cigarette rod 28 into the enlarged annular chamber 59, i.e., past the pronounced edges 57 which cause an abrupt drop of air pressure to atmospheric pressure on entry into the chamber 59. This also contributes to the desirable phenomenon that compressed air (or another suitable gaseous fluid) acts only upon successive narrow annular increments of the advancing tubular wrapper forming part of the cigarette rod 28. All that is necessary is to ensure that the pressure of air entering the testing compartment 53 is maintained at a constant value. Air which enters the enlarged annular chamber 59 and the pressure of which changes until it reaches atmospheric pressure can escape into the atmosphere via aerating orifices 61.

In accordance with a feature of the invention, the pressure of air in the compartment 53 is maintained at a constant value even if the diameters of certain portions of the advancing cigarette rod 28 change. Let it be assumed that the diameter (and hence the cross-sectional area) of the cigarette rod 28 decreases, i.e., that a greater quantity of air flows from the testing compartment 53, through the clearance 58 and into the enlarged annular chamber 59. This results in a short-lasting drop of air pressure; such pressure drop is communicated to the voltage converter 73 via conduit 74 whereby the converter transmits (via conductor 75) to the regulator 71 a pressure-denoting electric signal which causes the valve 69 to alter the rate of air flow in the conduit 68 from the flow meter 64 to the testing compartment 53 by way of the air supplying passage 54 in the nozzle 51. The purpose of the voltage regulator 71 is to compare electric signals being transmitted by the voltage converter 73 via conductor 75 with the electric signal then being transmitted by the source 72. Under the aforedescribed circumstances (i.e., if the diameter of a stretch of tubular wrapper advancing through the nozzle 51 is below the desired optimum diameter), the voltage regulator 71 adjusts the valve 69 in a sense to increase the quantity of compressed air flowing into the testing compartment 53. The valve 69 is adjusted again when the converter 73 detects that the pressure of air in the compartment 53 has reassumed the desired or required value.

The output of the voltage converter 73 transmits electric signals not only to the regulator 71 (via conductor 75) but also to one input of a signal processing circuit or unit 80 by way of a conductor 76. A second input 81 of the unit 80 receives reference signals denoting the lengths of cigarettes which are obtained in response to severing of the rod 28. The unit 80 is further connected, by a conductor 87, with the output of an actuating means 82 acting as a timing pulse generator, namely a means for actuating the unit 80 at intervals which are desired to cause the unit 80 to generate signals denoting the diameters of discrete longitudinally spaced-apart portions of the advancing cigarette rod 28.

The illustrated actuating means or timing pulse generator 82 comprises a rotary timer disc 84 and a proximity switch 86 which is connected to the corresponding input of the signal processing unit 80 by the aforementioned conductor 87. The disc 84 is driven in synchronism with the cutoff 31 of the cigarette maker 1 and includes two projections or lobes extending circumferentially of the disc along arcs of 90°. These two projections or lobes are disposed diametrically opposite each other with reference to the axis of the actuator 82. Thus, the proximity switch 86 is actuated (by the lobes of the disc 84) twice during each revolution of the disc 84 to transmit signals to the corresponding input of the signal processing unit 80.

The conductor 76 is arranged to transmit to the unit 80 a continuous signal which is indicative of the diameters of successive increments of the advancing cigarette rod 28, i.e., the testing unit 29 is arranged to determine the diameter of each and every increment of the rod which is caused to advance through the nozzle 51. However, the signals which are being transmitted by the conductor 87 cause the processing unit 80 to transmit to a signal displaying device 90 signals at certain intervals coinciding with those at which the cutoff 31 severs the rod 28. The intervals are of equal duration, i.e., the device 90 displays information denoting the diameters of discrete equally spaced-apart portions of the advancing rod 28.

The output of the signal generating unit 80 is connected with the displaying device 90 by a conductor 88. The latter also transmits signals to a regulating unit 92 which utilizes (processes) the signals to select the diameter of the cigarette rod 28. The parts 90 and 92 are constituents of the testing apparatus 90. An input 94 of the regulating unit 90 receives signals which denote the desired diameter of the cigarette rod 28. The output of the unit 90 transmits signals to the trimming device 19 as well as to the adjustable tandem sealer 27. This sealer can move nearer to or further away from the upper reach of the garniture 24 to thus reduce, or cause an increase of, the diameter of the cigarette rod 28 being formed in the wrapping mechanism 26. Such arrangement ensures that, whenever the signal from the voltage converter 73 denotes the presence of a cigarette rod portion having a diameter departing from the desired or required diameter, the regulating unit 92 causes the sealer 27 to alter the diameter as long as necessary, i.e., until the conductor 88 again transmits a signal denoting that the diameter of the advancing cigarette rod 28 is within the prescribed range.

The signal processing unit 80 is preferably designed or programmed in such a way that the (pressure denoting) signal being transmitted thereto via conductor 76 is processed by considering the signal which is received at its input 81 and which is indicative of the prescribed length of the cigarettes as well as by considering a timing pulse being transmitted by the conductor 87. The purpose of such signal processing at 80 is to ensure that the output signals at 88 induce the regulating unit 92 to guarantee that the cigarette rod 28 is severed at (e.g., midway across) the portions which are densified as a result of appropriate removal of surplus tobacco by the trimming device 19. Thus, the ends of discrete cigarettes which are obtained as a result of halving of the cigarettes 32 at the severing drum 38 are densified and have proper diameters for satisfactory attachment to the filter mouthpieces. Otherwise stated, the activating means (timing pulse generator) 82 enables the signal processing unit 80 to transmit (via conductor 88) signals which denote diameters desired to be those of discrete longitudinally spaced-apart portions of the rod 28, namely at least the optimum diameters of those end portions of the cigarettes obtained at 38 which are to be attached to the filter mouthpieces by uniting bands, e.g., in a manner as disclosed in the aforementioned U.S. Pat. No. 5,135,008 to Oesterling et al.

The operation of the timing pulse generator 82 can be synchronized with the lengthwise movement of the cigarette rod 28 in such a way that the conductor 87 transmits rectangular pulses which are generated when the annular testing compartment 53 of the nozzle 51 surrounds a portion of the advancing rod 28 to be located at that end of a cigarette which will be connected to a filter mouthpiece.

Figure 3:
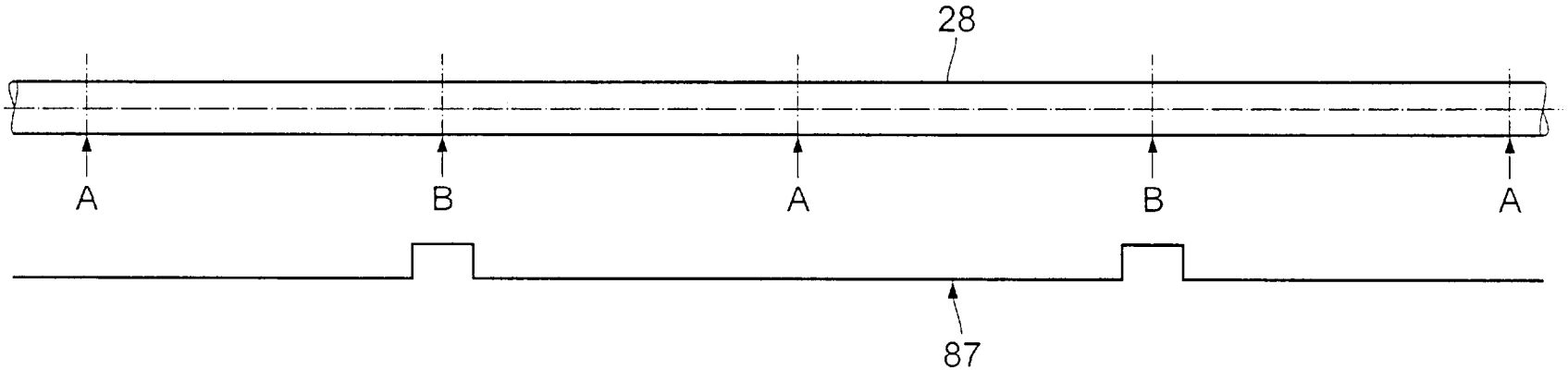
FIG. 3 is a diagram wherein the curve shows the pulses being generated by a pulse generator constituting a component part of the apparatus which is illustrated in FIGS. 1 and 2.

The congruence between the timing signals or pulses being transmitted by the conductor 87 and the cigarette rod 28 is shown schematically in FIG. 3. The reference characters A denote those longitudinally spaced-apart portions of the advancing rod 28 which are severed by the cutoff 31 to convert this rod into a series or file of plain cigarettes 32 of double unit length. The free ends of cigarettes of unit length which are obtained by halving each cigarette 32 are those ends of filter cigarettes which are lighted by the smokers, i.e., the ends remote from the respective filter mouthpieces.

The reference characters B denote in FIG. 3 those ends of the cigarettes of unit length which are to be connected with filter mouthpieces and which are obtained by severing each cigarette 32 at 38, prior or subsequent to introduction into the tipping machine 37. The trimming device 19 is preferably set up in such a way that it causes the rod-like tobacco filler of the cigarette rod 28 to contain more tobacco at each of the locations A and B. This ensures that the tobacco-containing part of each filter cigarette produced in the tipping machine 37 has a first dense end which is remote from and a second dense end which is adjacent the respective mouthpiece. The median portion of the tobacco-containing part of each filter cigarette normally or often contains less tobacco than the end portions. Therefore, the end portions of each such tobacco-containing part can have diameters greater than that of the median portion.

It is also possible to design the trimming device 19 in such a way that the density of each portion A departs from the densities of the portions B. This can result in the making of a cigarette rod 28 having a first diameter at A and a second diameter at B, or a first diameter at A, a second diameter at B and a third diameter between A and B. As a rule, it is particularly important to ensure that the diameter at B match the diameter of the adjacent end of the mouthpiece. Otherwise stated, the apparatus 29 of FIGS. 1 to 3 is preferably designed in a way to ensure that, at the very least, each portion B of the rod 28 will have a predetermined diameter.

FIG. 3 shows that the portions A and B of the illustrated cigarette rod are equidistant from each other. The reason is that the frequency of signals being transmitted by the timing pulse generator 82 (via conductor 87) is synchronized with the speed of lengthwise forward movement of the rod 28.

The improved method and apparatus are susceptible of numerous additional modifications without departing from the spirit of the invention. For example, the pneumatically operated components of the testing apparatus can be replaced with other suitable components, e.g., with optical elements.

An important advantage of the improved methods and apparatus is that, even though it is possible to continuously monitor the diameter of a continuously advancing rod-shaped article, it is equally possible to select those specific longitudinally spaced-apart portions of a rod-shaped article which are of particular interest as far as their diameters are concerned. Furthermore, such selective visual displaying and/or processing of information pertaining to the diameters of specific portions of an advancing rod-shaped article can be achieved in a very simple and relatively inexpensive but highly reliable manner.

The utilization of means (nozzle 51) for continuously monitoring the diameter of the advancing article 28 constitutes an optional but highly desirable feature of the invention. This contributes to the simplicity of those steps of the method(s) and of those constituents of the apparatus which are necessary to reliably ascertain the diameters of selected portions of the rod-shaped article.

Another important advantage of the improved methods and apparatus is that they can be put to use to improve the quality of certain smokers' products, such as filter cigarettes, which are turned out by available makers of smokers' products and by available machines or production lines for further processing of such products with a greatly reduced number of rejects and with relatively minor modifications of such machines and/or production lines. Thus, one can turn out high-quality filter cigarettes in existing combinations of cigarette makers and tipping machines by incorporating therein a relatively simple diameter ascertaining and altering apparatus which can consist of available components or of available groups of components. It has been ascertained that the incorporation of the apparatus 29 of FIG. 2 or an equivalent thereof enables the production line (1+37) of FIG. 1 or an equivalent to turn out high-quality filter cigarettes or the like at a rate which is achievable only with most recent versions of mass producing production lines.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of ascertaining the diameters of rod-shaped products and, therefore, such adaptations should and are intended to be comprehended within the meaning and range of equivalence of the appended claims.

What is claimed is:

1. A method of ascertaining the diameter of an elongated rod-shaped article, comprising the steps of:

advancing the article lengthwise at one of a plurality of different speeds, wherein the article is advanced in a direction parallel to the axis of the article;

monitoring the diameter of the advancing article;

generating signals denoting the diameters of discrete longitudinally spaced-apart portions of the advancing article; and varying the frequency of signal generation as a function of variations of the speed of lengthwise movement of the article so that said portions of the advancing article remain equidistant from each other.

2. The method of claim 1, wherein the article includes a filler and a tubular wrapper for the filler.

3. The method of claim 2, wherein the filler contains at least one of a smokable material and filter material for smoke.

4. The method of claim 1, wherein the article contains a continuous trimmed filler.

5. The method of claim 1, wherein said monitoring step includes monitoring the diameters of successive increments of the advancing article, said discrete portions being separated from each other by pluralities of said increments.

6. The method of claim 1, wherein the article includes a filler of smokable material having longitudinally spaced-apart densified sections, each of said portions at least substantially coinciding with a different one of said sections.

7. The method of claim 6, further comprising the step of severing the article at each of said sections.

8. The method of claim 7, wherein said severing step includes subdividing the article into a succession of discrete rod-shaped smokers' products each having one of (a) a unit length and (b) a multiple unit length.

9. A method of making an elongated rod-shaped article having a variable diameter, comprising the steps of:

confining an elongated filler into a tubular wrapper and advancing the thus obtained elongated article lengthwise at one of a plurality of different speeds and in a direction which is parallel to the axis of the article;

monitoring the diameter of the advancing article;

generating signals denoting the diameters of discrete longitudinally spaced-apart portions of the advancing article;

varying the frequency of signal generations as a function of variations of the speed of lengthwise movement of the article so that said portions of the advancing article remain equidistant from each other; and utilizing said signals to select the diameter of the article prior to said monitoring step.

10. The method of claim 9, wherein the filler contains at least one of a continuous smokable material and a continuous filter material for smoke.

11. Apparatus for ascertaining the diameter of an elongated rod-shaped article, comprising:

means for advancing the article lengthwise along a predetermined path;

means for monitoring the diameter of the advancing article in a predetermined portion of said path, including signal generating means actuatable to generate signals denoting the diameter of the article; and means for actuating said signal generating means at intervals so that said signals denote the diameters of discrete longitudinally spaced-apart portions of the advancing article wherein said advancing means is arranged to move the article at any one of a plurality of different speeds, said actuating means being arranged to actuate said signal generating means in such a way that said longitudinally spaced-apart portions of the advancing article are at least substantially equidistant from each other irrespective of the speed of the advancing article.

12. The apparatus of claim 11, wherein said monitoring means further includes a sensor arranged to ascertain the diameters of successive increments of the advancing article, said discrete portions of the advancing article being spaced apart from each other by pluralities of said increments.

13. The apparatus of claim 11 for ascertaining the diameter of an article having longitudinally spaced-apart densified sections each of which at least substantially coincides with one of said portions of the advancing article.

14. The apparatus of claim 13, further comprising means for severing the advancing article at said spaced-apart densified sections.

15. The apparatus of claim 11, wherein said advancing means forms part of a machine for making cigarettes.

16. The apparatus of claim 15, further comprising means for utilizing said signals to select the diameter of the article.

17. The apparatus of claim 16, wherein said utilizing means includes means for processing said signals.

* * * * *